United States Patent [19]

Johnson

[11] Patent Number: 4,575,874

[45] Date of Patent: Mar. 18, 1986

[54] PAD FOR A SHOULDER STRAP

[76] Inventor: William M. Johnson, P.O. Box 70404, Eugene, Oreg. 97401

[21] Appl. No.: 702,787

[22] Filed: Feb. 19, 1985

[51] Int. Cl.[4] ..... A41D 27/26; A41D 13/00

[52] U.S. Cl. ..... 2/268; 2/2

[58] Field of Search ..... 2/268, 2; 24/73 LR

[56] References Cited

U.S. PATENT DOCUMENTS

| | | | |
|---|---|---|---|
| 2,497,808 | 2/1950 | Zacks | 2/268 |
| 2,823,383 | 2/1958 | Crawford | 2/2 |
| 2,823,384 | 2/1958 | Eilersten | 2/2 |

*Primary Examiner*—Doris L. Troutman

*Attorney, Agent, or Firm*—James D. Givnan, Jr.

[57] ABSTRACT

A foldable pad having a base member with resilient material to cushion strap exerted loads on the shoulder. A positionable member of the pad may fold along a fold line into overlying relationship both with the base member and with a strap segment in place thereon. Fabric closure material of the hook and loop type in place on the opposing faces of the members serves to maintain a fixed relationship between strap and pad while retaining the pad in closed configuration. Frictional elements on the pad prevent pad displacement along a strap segment.

9 Claims, 4 Drawing Figures

PAD FOR A SHOULDER STRAP

BACKGROUND OF THE PRESENT INVENTION

The present invention pertains generally to the construction of a pad for cushioning the load exerted on a shoulder by a strap such as one associated with an undergarment.

The prior patent disclosures are based on various types of pads which share the common objective of reducing or distributing strap exerted loads on a surface area of the shoulder. The pads vary in providing for detachable engagement with the strap. Regardless of the several types of pad constructions disclosed in the art the same have not been widely accepted for use with various strap equipped garments.

A drawback to some pad types is their manner of strap attachment which entails considerable effort to attach and remove the pad from a strap such as threading of a strap end through slots in the pad. Other pad types include metal components which are undesirable from a laundering standpoint. Additional pad types make no provision for the prevention of pad slippage along a strap.

SUMMARY OF THE PRESENT INVENTION

The present invention is embodied in a pad suited for folded engagement with an undergarment strap such a a brassiere strap.

The present pad is adapted to be folded about a strap segment with means provided to center the pad on the strap segment. The pad utilizes fabric closure material to hold the pad closed in place on the strap in a manner permitting convenient separation from the strap for laundering purposes. Friction between the pad strap segment may be enhanced by pieces of fabric closure material engageable with said segment.

The present strap attachable pad has an objective the provision of a pad which may be readily applied and removed from a shoulder strap without strap detachment from the garment being required; the provision of a folded pad having a fold line along one edge of the pad with the pad having halves held closed by closure material; the provision of a strap pad with closure material additionally serving to orientate the pad to the strap; the provision of a pad which provides a strap engaging frictional element to prevent pad slippage; the provision of a pad which is unobstrusive when worn.

DETAILED DESCRIPTION OF THE PREFERRED EMBODIMENTS

Figure 1:
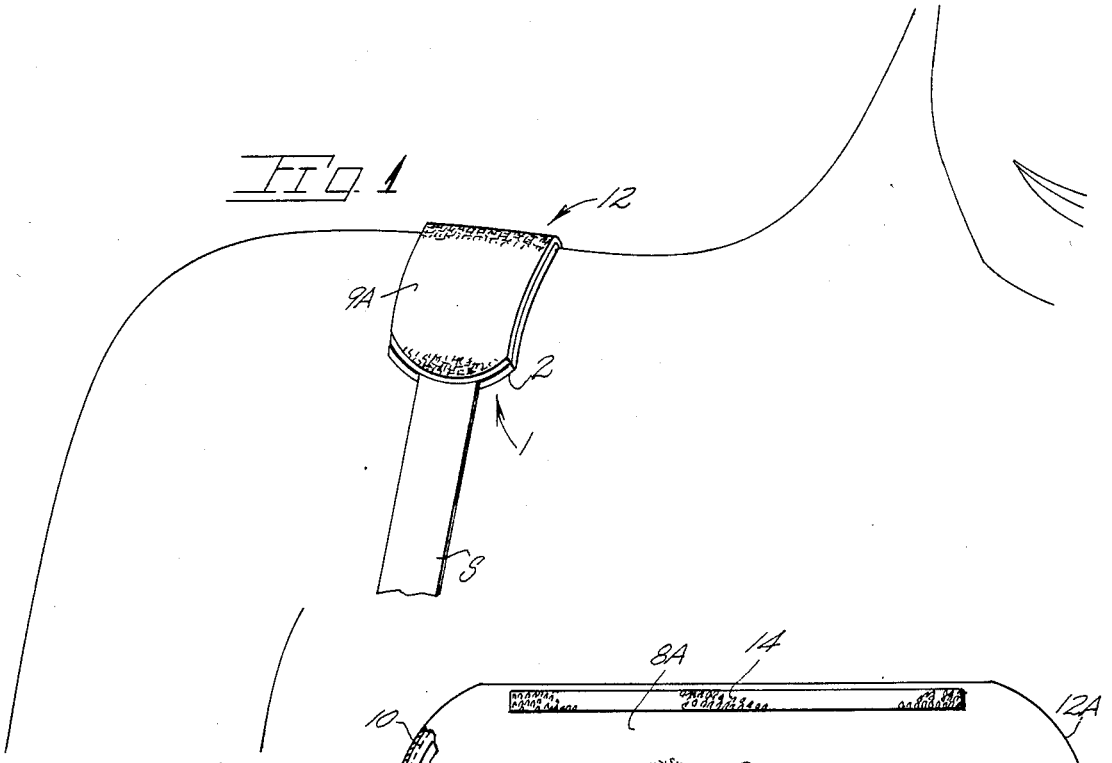
FIG. 1 is a perspective view of the present pad in place on a shoulder strap.
Figure 2:
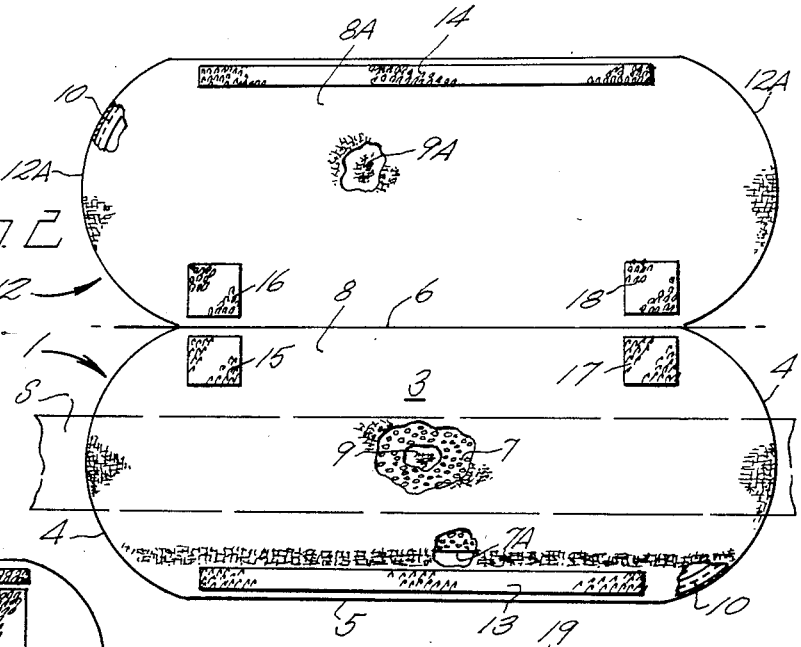
FIG. 2 is a plan view of the pad removed from the strap and in an open configuration.

With continuing attention to the drawing wherein parts are identified by reference numerals similarly hereinafter utilized, the reference numeral 1 indicates generally the elongate base member of the present pad.

Said base member has a lower side 2 and an upper side 3 for respective engagement with the shoulder and a brassiere strap S. The base member is elongate having curved ends 4 and a free side 5. A fold line at 6 defines the remaining side of the pad.

Figure 3:
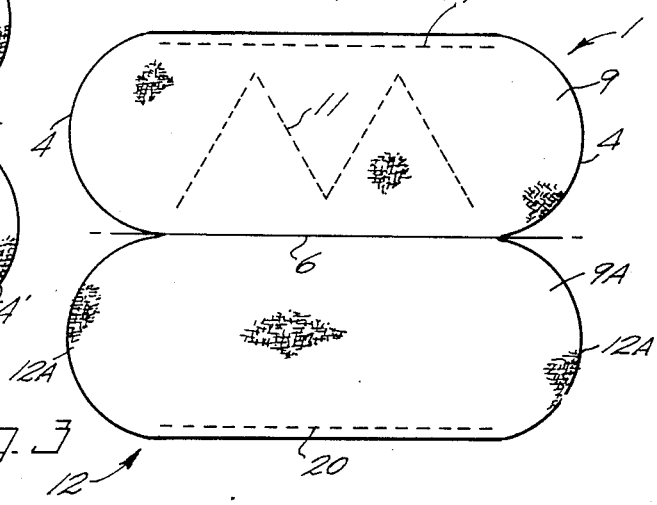
FIG. 3 is a bottom plan view of FIG. 2 on a reduced scale.

A cushion component 7 occupies the inner area of the base member and is of open cell material such as a resilient foam. Fabric pieces 8 and 9 are stitched at 10 to one another about the base member ends and free side. Stitching at 11 (FIG. 3) holds the cushion in place.

A positionable pad member indicated generally at 12 is integral with base member 1 along fold line side 6 and corresponds in shape thereto. For convenience of manufacture, positionable member 12 may be constructed as extensions 8A–9A of fabric exteriors 8 and 9 and of corresponding shape to permit the positionable member to be folded along the fold line into superimposition on base member 1. Fold line 6 defines a side of the positionable pad with curved ends at 12A.

Marginally located fabric closure pieces of the hook and loop type at 13 and 14 adjacent the free side of each member engage one another when the pad is folded about strap segment 5 to hold the pad closed. Paired fabric closure material pieces at 15–16 and 17–18 within marginal areas of the pad members similarly engage one another upon closure of the pad and serve primarily to confine the strap against displacement toward the fold line. Pieces 13 and 14, in addition to holding the pad closed, limit strap displacement in a direction away from the fold line. Stitching at 19 and 20 secures pieces 13 and 14 in place.

Figure 4:
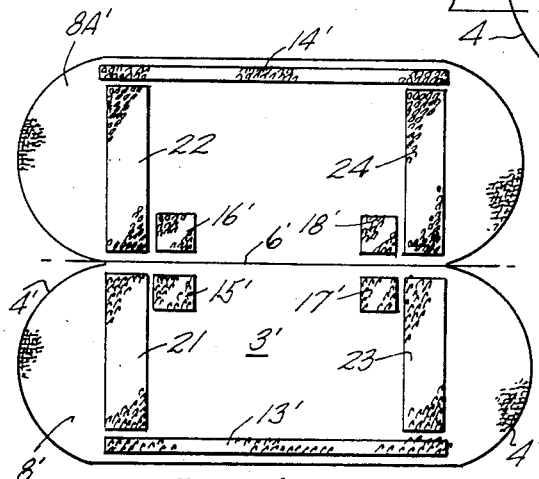
FIG. 4 is a view similar to FIG. 2 but showing a modified form of the pad.

In the modified form of the invention shown in FIG. 4, frictional elements 21–22 and 23–24 are provided on the opposing faces of the pad when same is closed. The frictional elements may be fabric members of the type having a coarse or rough feel to provide frictional engagement with a strap segment. Suitable frictional elements are cooperating lengths of hook and loop closure material, transversely disposed, with frictional means 22 and 24 being of loop construction and elements 21 and 23 being of hook construction.

The closure material piece 13 may be recessed below the major surface area of the base member by reason of the cushioning material terminating inwardly offset at 7A from free side 5 of the base member. This arrangement provides a regular or smooth upper surface of the pad constributing to the pad being inconspicuous. In the modified form, structure analogous to the first described form of the pad is identified by like prime reference numerals.

While I have shown but a few embodiments of the invention, it will be apparent to those skilled in the art that the invention may be embodied still otherwise without departing from the spirit and scope of the invention.

Having thus described the invention, what is desired to be secured in Letters Patent is:

I claim:

1. A pad for cushioning strap exerted loads on the shoulder of a human body, said pad comprising in combination, an elongate base member including a cushion component, a positionable member integral with said base member for superimposition on said base member upon movement of the positionable member about a fold line, and fabric closure material in place on marginal areas of said base member and said positionable member adapted for engagement upon movement of the positionable member about the pad fold line, said strap confined against lateral displacement by said fabric closure material.

2. The pad claimed in claim 1 wherein said elongate base member and said positionable member include fabric exteriors each formed from a continuous expanse of fabric.

3. The pad claimed in claim 1 wherein said fabric closure material is of the hook and loop type.

4. The pad claimed in claim 1 additionally including frictional elements in place on the base member for frictional engagement with an overlying strap to inhibit pad movement along said strap.

5. The pad claimed in claim 4 including additional frictional elements in place on said positionable member for superimposition on the strap and on the first mentioned frictional elements.

6. The pad claimed in claim 5 wherein said frictional elements are hook and loop type closure material extending beyond the strap edges.

7. The pad claimed in claim 1 wherein said elongate base member and said positionable member have corresponding sides with the fold line located therealong.

8. The pad claimed in claim 5 wherein said additional frictional elements are fabric closure pieces disposed transversely on said positionable member.

9. The pad claimed in claim 1 wherein a portion of said fabric closure material is offset from said cushion component to minimize pad thickness.

* * * * *